United States Patent [19]

Nicoletti

[11] 3,941,613

[45] Mar. 2, 1976

[54] HAIR FROSTING DEVICE

[76] Inventor: Robert E. Nicoletti, 3043 Wing St., San Diego, Calif. 92110

[22] Filed: Apr. 1, 1974

[21] Appl. No.: 456,542

[52] U.S. Cl. ..... 132/9

[51] Int. Cl.[2] ..... A45D 1/00

[58] Field of Search ..... 132/9; 220/4 B, 4 E, 31 S

[56] References Cited

UNITED STATES PATENTS

| | | | |
|---|---|---|---|
| 3,198,196 | 8/1965 | Sawin | 132/9 |
| 3,425,587 | 2/1969 | Duross, Jr. | 220/4 B |

*Primary Examiner*—G. E. McNeill

[57] ABSTRACT

A hair frosting device consisting of a container which is hinged on one side and snapped latched on the other so that it can be opened for placing a strand of hair therein. An opening at one end thereof is notched on one part of the container with cooperating notches on the other part for pulling the hair strand through and positioning it after which the container is filled with a hair treating liquid and closed. This allows the isolated treatment of one or more strands of hair without the problem of treating adjacent strands which are not desired to be treated.

1 Claim, 6 Drawing Figures

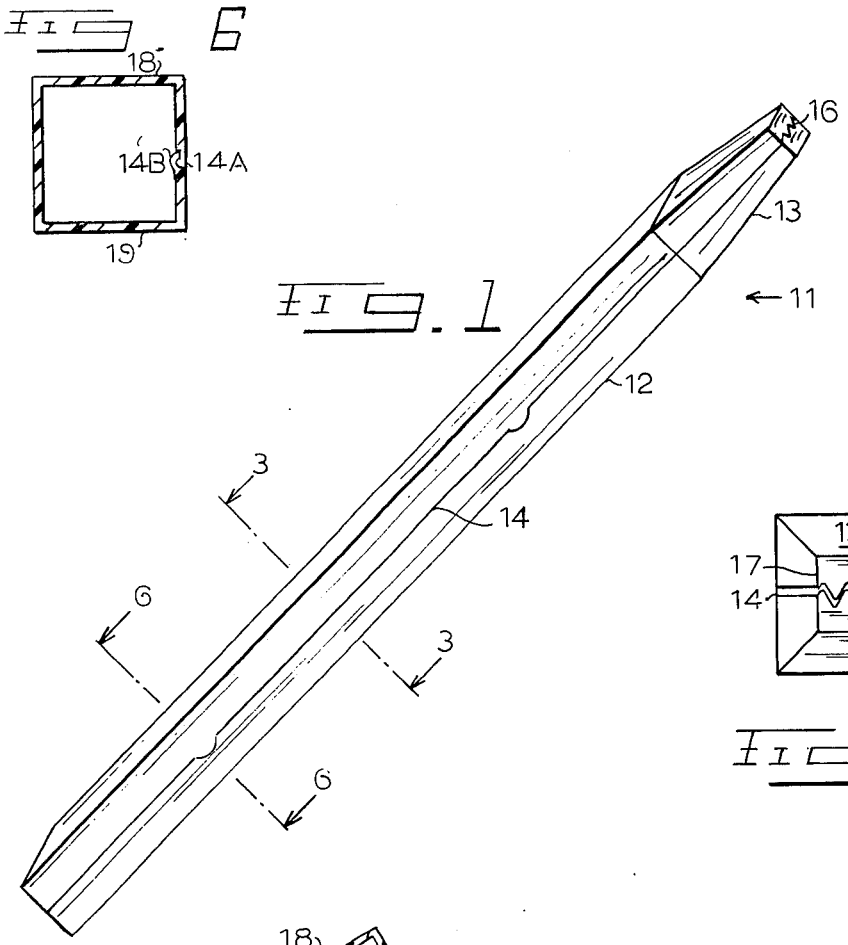
FIG. 1
FIG. 6
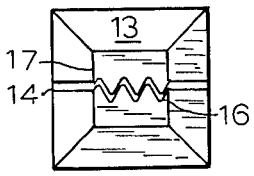
FIG. 2
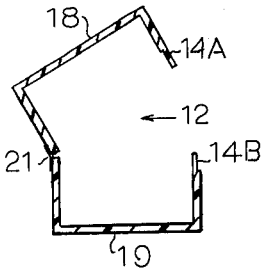
FIG. 3
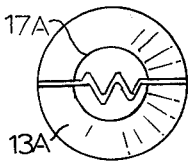
FIG. 4
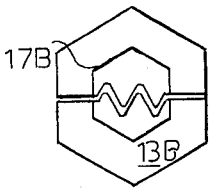
FIG. 5

HAIR FROSTING DEVICE

PRIOR ART

The following patents were discovered in a patentability preliminary search:

| | | |
|---|---|---|
| R.L. Sawin | August 3, 1965 | 3,198,196 |
| S.C. Sanzo | September 17, 1963 | 3,103,933 |
| Irene Murtha | May 16, 1972 | 3,662,767 |
| A.A. Nizetich | August 27, 1963 | 3,101,724 |
| James P. Williams | November 9, 1971 | 3,618,620 |

BRIEF DESCRIPTION OF THE INVENTION

The present invention relates to a hair frosting device and more particularly to a hair frosting device for isolating strands of hair for individual treatment.

According to the invention, a hair frosting device is provided in which an elongated container is hinged on one side and has a sealable seam for opening and closing on the other side. The seam terminates in a frontal reduced cross-sectional area face in which the seam is notched or saw-toothed for receiving a strand or strands of hair to be treated and positioning them during treatment. After the strands of hair are placed within the notched face portion of the seam, the container is filled with hair treating liquid and closed. Hence, the strands to be treated are isolated from the strands not to be treated and are held firmly in place through the utilization of the notched seam positioning area.

An object of the present invention is the provision of an improved hair frosting device.

Another object is the provision of a hair frosting device which positioning and isolates strands of hair to be treated.

A still further object of the invention is the provision of a hair frosting device which is inexpensive to manufacture and extremely simple in operation.

Other objects and many of the attendant advantages of the present invention will be readily appreciated as the same becomes better understood by reference to the following detailed description when considered in connection with the accompanying drawings in which like reference numerals designate like parts throughout the FIGS. thereof and wherein:

FIG. 1 is a prospective view of the preferred embodiment of the present invention;

FIG. 2 is an end elevational view of the embodiment of FIG. 2;

FIG. 3 is a cross-sectional view taken along lines 3—3 of FIG. 1;

FIG. 4 is an end elevational view of a modification of the embodiment of FIG. 1;

FIG. 5 is an end elevational view showing a further modification of the embodiment of FIG. 1; and FIG. 6 is a sectional view taken along lines 6—6 of FIG. 1.

DETAILED DESCRIPTION OF THE DRAWING

Referring to FIG. 1, the hair frosting device of the present invention is shown generally at 11 consisting of a rectangular container 12 terminating in a reduced cross-sectional converging section 13. Container 12 has a seam 14 which terminates in a notched or saw-toothed portion 16.

Referring to FIG. 2, the converging section 13 is shown terminating in a face 17. Seam 14 is shown terminating in a notched portion 16 on face 17.

Referring to FIG. 3, rectangular container 12 is shown generally having a top portion 18, a bottom portion 19 with a hinge 21 connecting top portion 18 and bottom portion 19. The seam portion of 14A of top portion 18 is shown in complimentary geometry with seam portion 14B of bottom section 19.

Referring to FIG. 4, converging sections 13A together with face portion 17A illustrating modification in that having a circular cross-section.

Referring to FIG. 5, converging section 13B together with base portion 17B illustrates an octagonal cross-section.

Referring to FIG. 6, top portion 18 and bottom portion 19 are shown latched by seam portion 14A of top portion 18 and seam portion 14B of bottom portion 19.

Referring back to FIGS. 1, 2, 3 and 6, it can be seen that when the unit is opened as shown in FIG. 3 a strand or strands of hair can be placed in the notched portion 16 of seam 14 and positioned therein. A liquid hair conditioner is then added into the open container after which it is snapped shut trapping the strands of hair in the notched portion 16 of seam 14 and isolating the strands therein from adjacent strands which are not being treated.

It should be understood, of course, that the foregoing disclosure relates to only a preferred embodiment of the invention and that it is intended to cover all changes and modifications of the example of the invention herein chosen for the purposes of the disclosure which do not constitute departues from the spirit and scope of the invention.

The invention claimed is:

1. A hair frosting device comprising:
   - an elongated container forming an enclosure for containing one or more strands of hair therein;
   - said container being hinged on one side and snap-latched on an opposite side, said snap latch consisting of a sealable seam;
   - said container terminating on one end in a flat face portion; and
   - said seam terminating across said flat face portion and having at least one notch therein for receiving and positioning at least one strand of hair therein, said at least one notch formed by completely complimentary edges operable for maintaining a seal therebetween.

* * * * *